US005081508A

United States Patent [19]

Kotani et al.

[11] Patent Number: 5,081,508

[45] Date of Patent: Jan. 14, 1992

[54] PAPER-JAM DETECTING DEVICE

[75] Inventors: Masakazu Kotani; Toshikazu Nishioka; Kazuhiro Hirata, all of Saitama, Japan

[73] Assignee: Fuji Xerox Co., Ltd., Tokyo, Japan

[21] Appl. No.: 604,007

[22] Filed: Oct. 26, 1990

[30] Foreign Application Priority Data

Nov. 9, 1989 [JP] Japan ..... 1-130855[U]

[51] Int. Cl.[5] ..... G03G 21/00

[52] U.S. Cl. ..... 355/316; 355/204; 355/319

[58] Field of Search ..... 355/204, 205, 206, 208, 355/311, 316, 319, 209, 318, 321

[56] References Cited

U.S. PATENT DOCUMENTS

| | | | |
|---|---|---|---|
| 4,394,088 | 4/1983 | Hanamoto et al. | 355/316 |
| 4,456,366 | 6/1984 | Komiya et al. | 355/311 X |
| 4,734,744 | 3/1988 | Yamamoto | 355/209 |
| 4,868,609 | 9/1989 | Nagata et al. | 355/208 |

FOREIGN PATENT DOCUMENTS

| | | | |
|---|---|---|---|
| 0005259 | 1/1986 | Japan | 355/313 |

*Primary Examiner*—A. T. Grimley
*Assistant Examiner*—P. Stanzione
*Attorney, Agent, or Firm*—Finnegan, Henderson, Farabow, Garrett and Dunner

[57] ABSTRACT

An image recording apparatus in which, when image recording is performed on both surfaces of a recording paper, the image recording is performed on one surface of recording paper taken into the apparatus, and after once conveyed into a paper discharge portion, the recording paper is taken into the apparatus again so that the image recording is performed on the other surface of the recording paper, the image recording apparatus comprising a recording paper detecting device for detecting the recording paper conveyed into the paper discharge portion, a time detecting device for detecting a time required for taking the detected recording paper into the apparatus, and a paper jam detecting a device for detecting paper jam on the basis of the time detected by the time detecting device.

3 Claims, 3 Drawing Sheets

PAPER-JAM DETECTING DEVICE

BACKGROUND OF THE INVENTION

The present invention relates to an image recording apparatus for performing picture recording on both surfaces of recording paper, and particularly relates to a paper jam detecting device for detecting paper jam of the recording paper.

In such an image recording apparatus of the kind as described above, conventionally, when picture recording (copying) is performed on both surfaces of recording paper, as shown in FIG. 4, toner 14 of a developing portion 13 is made to adhere onto a photosensitive body 12 electrically charged by laser light generated from a laser generating portion 11 so as to form a toner latent image, the formed toner latent image is transferred by a transfer charger 19 onto recording paper 18 conveyed by conveyer rollers 16 and 17 from a paper feed tray 15 so as to perform picture recording on the recording paper, and the recording paper 18 on which picture recording is performed is once conveyed into a discharge tray 22 by a conveyer roller 20 and a forwards rotating discharge roller 21. After a predetermined time has passed (just before the recording paper 18 is discharged onto the discharge tray 22), the discharge roller 21 is reversely rotated so as to take the recording paper 18 into the apparatus again, and the conveying path is switched by a not-shown switching lever so that the recording paper 18 is conveyed by the conveyer roller 23 into a conveying path shown at the lower portion in the drawing so as to be taken into the paper feed tray 15 again. The one-surface copied recording paper 18 is then conveyed by the conveyer rollers 16 and 17 again so that picture recording is performed on the other surface of the recording paper 18, and the recording paper 18 is discharged into the discharge tray 22 by the conveyer roller 20 and the discharge roller 21 which are controlled so as to rotate forwards.

In the above picture recording apparatus, however, there has been a problem in that since recording paper to be subject to picture copying on its both surfaces is once conveyed into the discharge tray as described above in order to reduce the number of parts to make the apparatus small in size and light in weight, recording paper which has been already discharged in the discharge tray adheres onto the recording paper once conveyed on the discharge tray by static electricity induced on the conveyed recording paper so that the former recording paper follows the recording paper to be subject to both surface copying when the discharge roller is reversely rotated. Accordingly, the recording paper which has been already discharged in the discharge tray is sometimes taken into the picture recording apparatus to cause paper jam in the apparatus.

SUMMARY OF THE INVENTION

The present invention has been attained in view of the problem described above, and an object thereof is to provide a paper jam detecting means for detecting abnormal conveyance at the time when recording paper which has already discharged in a paper discharge portion is taken into an image recording apparatus together with recording paper to be conveyed to thereby make it possible to prevent paper jam from occurring.

According to the present invention, in an image recording apparatus in which when picture recording is performed on both surfaces of the recording paper, picture recording is performed on one surface of recording paper taken by means of conveyer rollers or the like into the apparatus, and after once conveyed by means of conveyer rollers or the like into a paper discharge portion, the recording paper is taken into the apparatus again so that picture recording is performed on the other surface of the recording paper, a paper jam detecting device comprises: a recording paper detecting means such as a sensor or the like for detecting recording paper conveyed into the paper discharge portion; a paper take-in time detecting means such as a central processing unit (hereinafter referred to as "CPU") for detecting a time required for taking the detected recording paper into the apparatus; and a paper jam detecting means such as a CPU for detecting paper jam of the recording paper on the basis of the detected paper take-in time.

The taken-in time detecting means detects the time from the detection of the recording paper conveyed into the paper discharge portion till the recording paper is taken in the apparatus. When the take-in time exceeds a predetermined reference time, the paper jam detecting means detects the paper jam of the recording paper.

Accordingly, for example, when recording paper which has already discharged in the paper discharge portion is drawn into the picture recording apparatus together with recording paper which is to be taken into the apparatus once more so as to be subject to both surface copying, the abnormal conveyance of the recording paper is judged before actual occurrence of paper jam, that is, in the stage in which the cause of the paper jam is detected, so that the actual paper jam due to abnormal conveyance can be prevented.

DETAILED DESCRIPTION OF THE PREFERRED EMBODIMENTS

Figure 1:
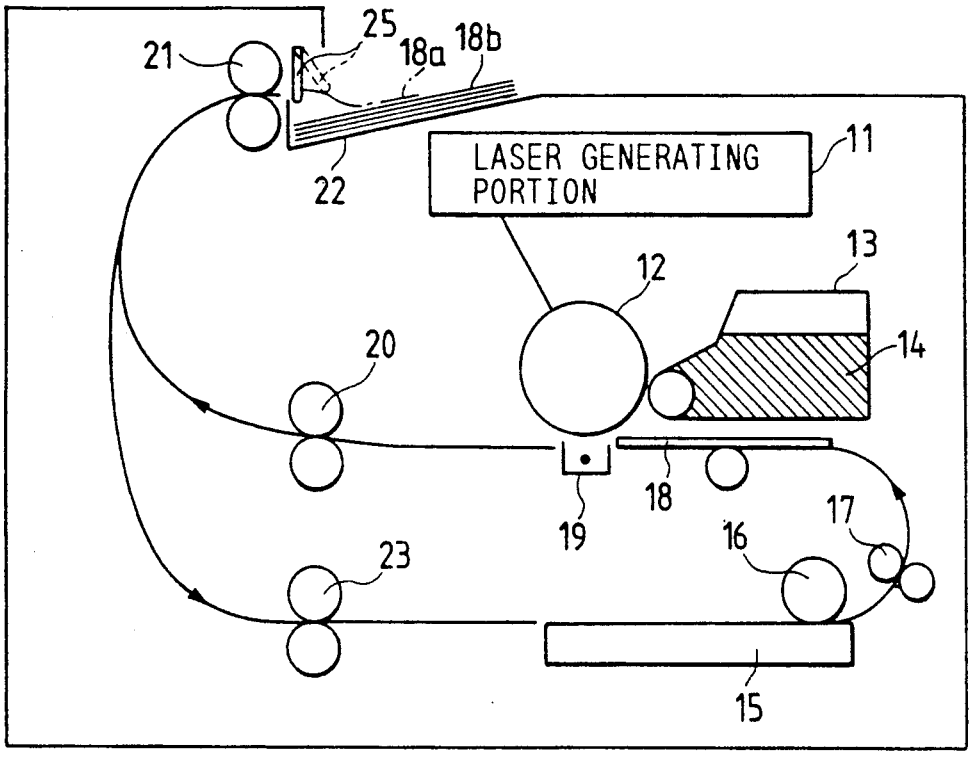
FIG. 1 is a constituent view showing a schematic configuration of an image recording apparatus using the paper jam detecting device according to the present invention.
Figure 2:
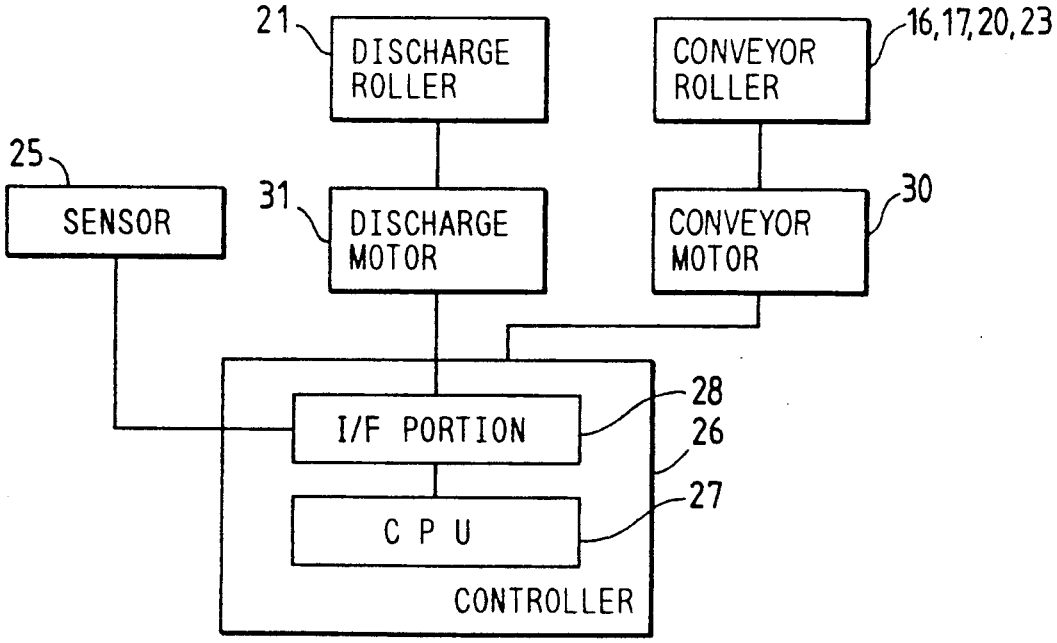
FIG. 2 is a schematic block diagram of the paper jam detecting device shown in FIG. 1.
Figure 3:
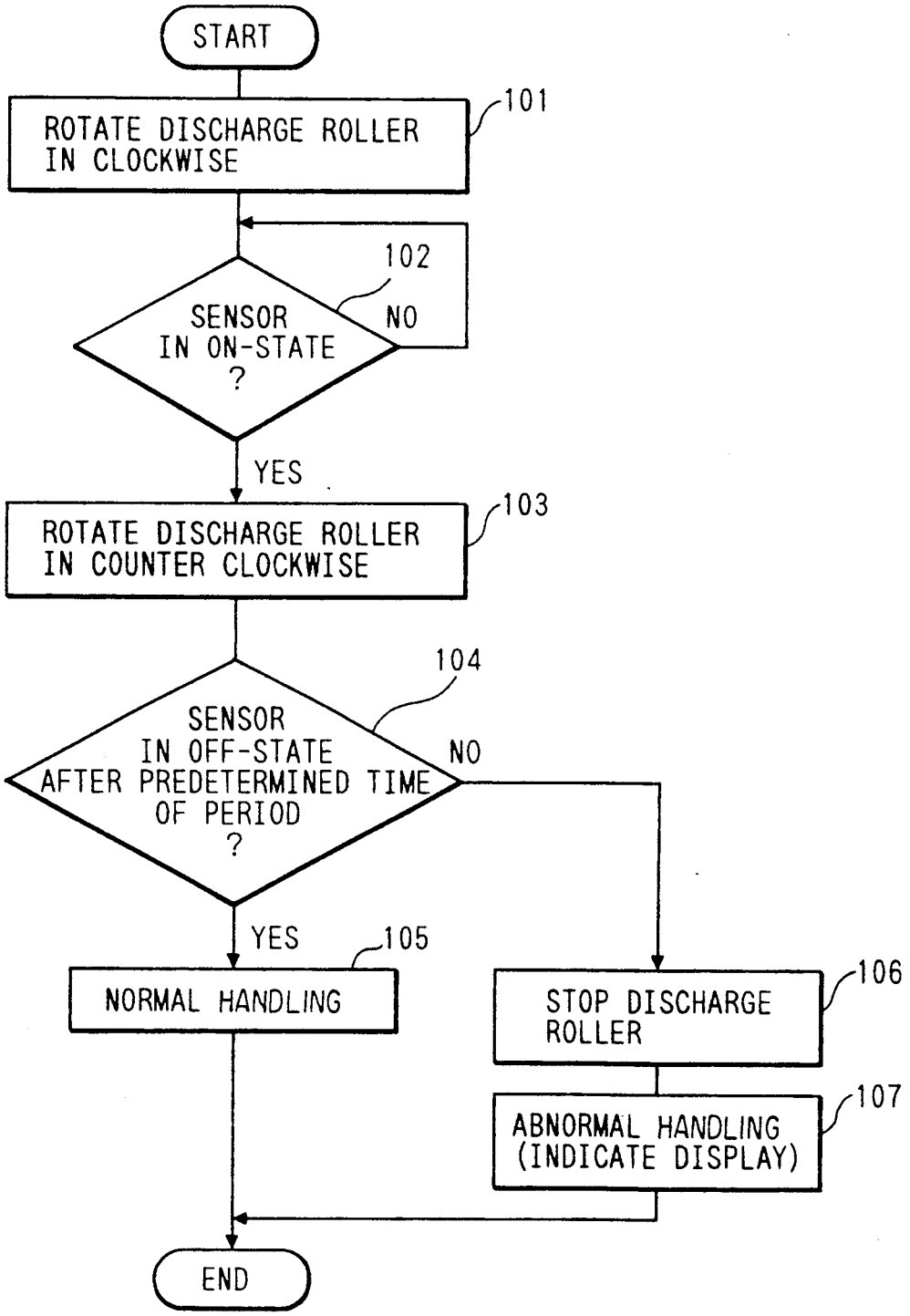
FIG. 3 is a flowchart for explaining the paper jam detecting operation by use of the paper jam detecting device.

Referring to FIGS. 1 through 3, an embodiment of the present invention will now be described in detail.

Figure 4:
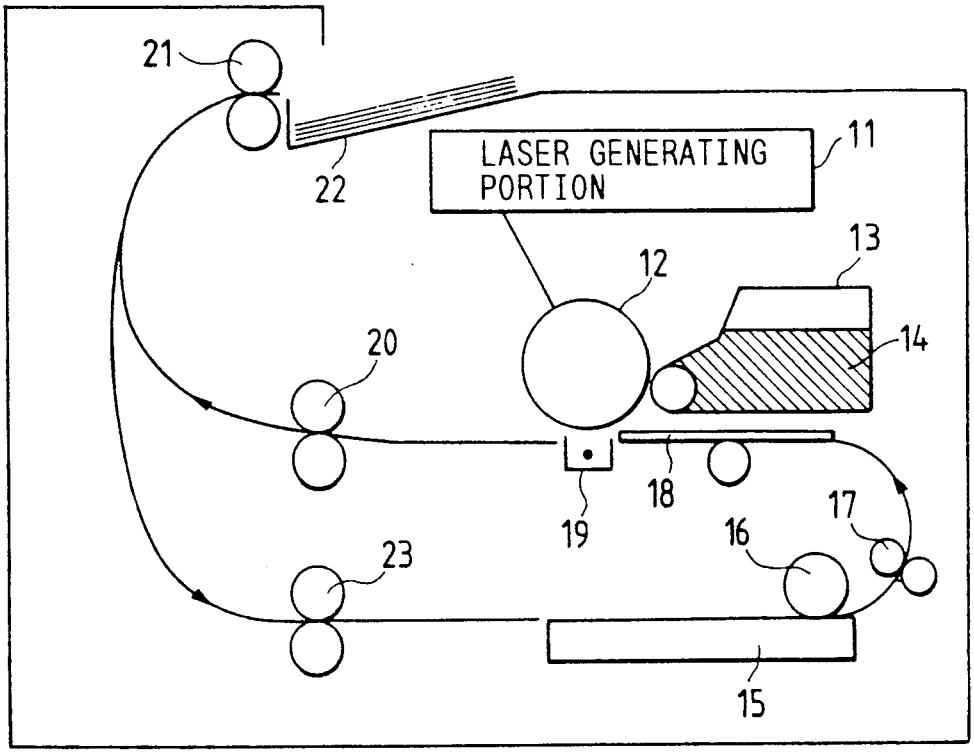
FIG. 4 is a constituent view showing a schematic configuration of a conventional picture recording apparatus.

FIG. 1 is a constituent view showing a general configuration of an image recording apparatus using a paper jam detecting device according to the present invention. In the drawing, the constituent parts similar to those in FIG. 4 are correspondingly referenced, and the description thereof will be omitted.

In the drawing, a recording paper detection sensor 25 is provided in the vicinity of the discharge roller 21 and above the discharge tray 22. Accordingly, when recorded paper 18*a* (one-dotted chain line in the drawing) on which picture recording has been performed on its one surface is conveyed by the discharge roller 21 to the discharge tray 22, the sensor 25 outputs an ON-state detection signal when the sensor is moved by the recording paper into the position shown by a broken line in the drawing, while the sensor 25 outputs an OFF-state detection signal when the recording paper is taken into the apparatus and the sensor is moved into the position shown by a solid line.

FIG. 2 is a schematic block diagram of the paper jam detecting apparatus according to the present invention. In the drawing, the paper jam detecting apparatus is constituted by the recording paper detecting sensor 25, and a controller 26 constituted by a CPU 27 and an interface portion 28. The CPU 27 controls the drive of a conveyer motor 30 for rotating the conveyer rollers 16, 17, 20, and 23, and a discharge motor 31 for rotating the discharge roller 21. The CPU 27 judges whether recording paper to be subject to both surface copying is conveyed normally or abnormally on the basis of the detection signal (ON-state or OFF-state detection signal) applied from the sensor 25. That is, the CPU 27 controls the drive of the discharge motor 31 and the conveyer motor 30 so as to stop the rotation of the reversely, that is, clockwise rotating discharge roller 21 and conveyer rollers 16, 17, 20, and 23 in the case of abnormal conveyance. For example, when recording paper 18*b* (see FIG. 1) previously discharged on the discharge tray 22 adheres to the conveyed recording paper 18*a* by static electricity or the like induced on the recording paper 18*a* conveyed into the discharge tray 22 by the discharge roller 21 rotated forwards, the recording paper 18*b* is drawn into the picture recording apparatus while following the recording paper 18*a* when the discharge roller 21 is rotated reversely.

Referring to a flowchart of FIG. 3, the paper jam detecting operation will now be described hereunder. In the drawing, recording paper 18 is conveyed by the rotation of the conveyer rollers 16, 17, 20, and 23, and picture recording is performed on one surface of the recording paper 18, the CPU 27 controls the drive of the discharge motor 31 so as to rotate the discharge roller 21 forwards, (in step 101) to thereby once convey the recording paper into the discharge tray 22, and the CPU 27 judges whether the sensor 25 has been turned into the ON-state by the recording paper 18 or not (in step 102).

When the sensor 25 moves in the direction of the broken line (see FIG. 1) to thereby output an ON-state detection signal, the CPU 27 controls the drive of the discharge motor 31 so as to rotate the discharge roller 21 reversely (in step 103) to thereby take the recording paper 18 into the apparatus, and the CPU 27 judges after lapse of a predetermined time whether the sensor 25 has been turned in the OFF-state (in step 104).

When the sensor 25 is moved in the direction the solid line (see FIG. 1) after lapse of the predetermined time, that is, just before the recording paper 18 is discharged into the discharge tray 22 to thereby output an OFF-state detection signal, the CPU 27 judges that the conveyance of the recording paper is normal and performs normal processing in which the recording paper 18 is conveyed into the paper feed tray 15 by the conveyer roller 23 and then conveyed by the conveyer rollers 16 and 17 again so that picture recording is performed on the other surface of the recording paper 18, and then the recording paper 18 is discharged into the discharge tray 22 by means of the conveyer roller 20 and the discharge roller 21 (in step 105). Thus, the operation is completed. The judgement of the lapse of the predetermined time is performed, for example, in a manner so that reference times respectively corresponding to various paper sizes are previously set, and the reference time corresponding to the paper size of the currently conveyed recording paper is counted down.

Further, if the sensor 25 is not turned in the OFF-state after lapse of the predetermined time, the CPU 27 judges that the conveyance of the recording paper is abnormal and controls the drive of the discharge motor 31 and the conveyer motor 30 so as to stop the rotation of the discharge roller 21 and the conveyer rollers 16, 17, 20, and 23 (in step 106). Then, the CPU 27 performs abnormality processing, for example, making a display showing abnormal conveyance on a not-shown display panel of the picture recording apparatus (in step 107) so as to inform an operator of the abnormality. Thus, the operation is completed.

According to the present invention, if recording paper which has been already discharged in the discharge tray adheres onto recording paper to be subject to both-surface copying which is taken from the discharge tray into the apparatus again so as to be drawn into the picture recording apparatus, the abnormality is detected in the early stage and the rollers are stopped, so that the abnormal conveyance is judged before actual paper jam occurs, that is, in the stage where the cause is detected. Accordingly, the actual paper jam can be prevented, so that the picture recording apparatus can be stopped without damaging recording paper on which picture recording has been once performed and which has been once discharged normally.

As described above, the abnormal conveyance is detected in the stage in which recording paper which has been already discharged into the paper discharge portion is drawn in the picture recording apparatus together with recording paper to be conveyed, so that the actual paper jam due to the abnormal conveyance can be prevented.

what is claimed is:

1. An image recording apparatus in which, when image recording is performed on both surfaces of a recording paper, the image recording is performed on one surface of the recording paper taken into the apparatus, and after once conveyed into a paper discharge portion, the recording paper is taken into the apparatus again so that the image recording is performed on the other surface of the recording paper, the image recording apparatus comprising:

recording paper detecting means for providing an output signal at an instant when said recording paper is conveyed into said paper discharge portion;

time detecting means for detecting a time required from said instant until said detected recording paper is taken into said apparatus; and paper jam detecting means for detecting a paper jam based on the output signal of said recording paper detecting means and the time detected by said time detecting means.

2. An image recording apparatus as claimed in claim 1, wherein said time is determined by a size of said recording paper.

3. An image recording apparatus as claimed in claim 1, wherein said paper detecting means includes a sensor for outputting an On-state signal when said recording paper having a recorded image on one surface is conveyed to the discharge portion, and for outputting an Off-state signal when said recording paper is taken into said apparatus, again.

* * * * *